US009874840B2

(12) United States Patent
Gotoh et al.

(10) Patent No.: US 9,874,840 B2
(45) Date of Patent: Jan. 23, 2018

(54) FIXING DEVICE AND IMAGE FORMING APPARATUS INCLUDING A FIXING DEVICE

(71) Applicant: FUJI XEROX CO., LTD., Tokyo (JP)

(72) Inventors: Yasutaka Gotoh, Yokohama (JP); Sou Morizaki, Yokohama (JP); Jouta Kobayashi, Yokohama (JP); Kyogo Soshi, Yokohama (JP); Hiroko Furukata, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/257,399

(22) Filed: Sep. 6, 2016

(65) Prior Publication Data

US 2017/0261899 A1 Sep. 14, 2017

(30) Foreign Application Priority Data

Mar. 9, 2016 (JP) ..... 2016-045659

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2017; G03G 15/2039; G03G 15/2078
USPC ..... 399/329
See application file for complete search history.

(56) References Cited

U.S. PATENT DOCUMENTS

2015/0078793 A1 3/2015 Takahashi et al.

FOREIGN PATENT DOCUMENTS

JP 2009128849 A * 6/2009
JP 2015-059981 A 3/2015
JP 2016-099367 A 5/2016

OTHER PUBLICATIONS

Aug. 2, 2016 Office Action issued in Japanese Patent Application No. 2016-045659.

* cited by examiner

*Primary Examiner* — Billy Lactaoen
(74) *Attorney, Agent, or Firm* — Oliff PLC

(57) ABSTRACT

There is provided a fixing device. An endless belt comes into contact with a developer image on a recording medium. A heat source is provided on an inner side of the belt and emits radiant heat. A heat transmitting member includes a contact portion which contacts with an inner circumferential surface of the belt, absorbs the radiant heat of the heat source, and transmits the heat to the belt. A deforming unit deforms when a temperature of the contact portion exceeds a predetermined setting temperature, and separates the belt and at least a part of the contact portion from each other.

1 Claim, 10 Drawing Sheets

FIXING DEVICE AND IMAGE FORMING APPARATUS INCLUDING A FIXING DEVICE

CROSS-REFERENCE TO RELATED APPLICATIONS

This application is based on and claims priority under 35 USC 119 from Japanese Patent Application No. 2016-045659 filed Mar. 9, 2016.

TECHNICAL FIELD

The present invention relates to a fixing device and an image forming apparatus.

SUMMARY

According to an aspect of the embodiments of the present invention, there is provided a fixing device comprising: an endless belt that comes into contact with a developer image on a recording medium; a heat source that is provided on an inner side of the belt and emits radiant heat; a heat transmitting member that includes a contact portion which contacts with an inner circumferential surface of the belt, absorbs the radiant heat of the heat source, and transmits the heat to the belt; and a deforming unit that deforms when a temperature of the contact portion exceeds a predetermined setting temperature, and separates the belt and at least a part of the contact portion from each other.

BRIEF DESCRIPTION OF THE DRAWINGS

Exemplary embodiments of the present invention will be described in detailed based on the following figures, wherein.

DETAILED DESCRIPTION

First Exemplary Embodiment

An example of a fixing device and an image forming apparatus according to a first exemplary embodiment will be described.

[Entire Configuration]

Figure 1:
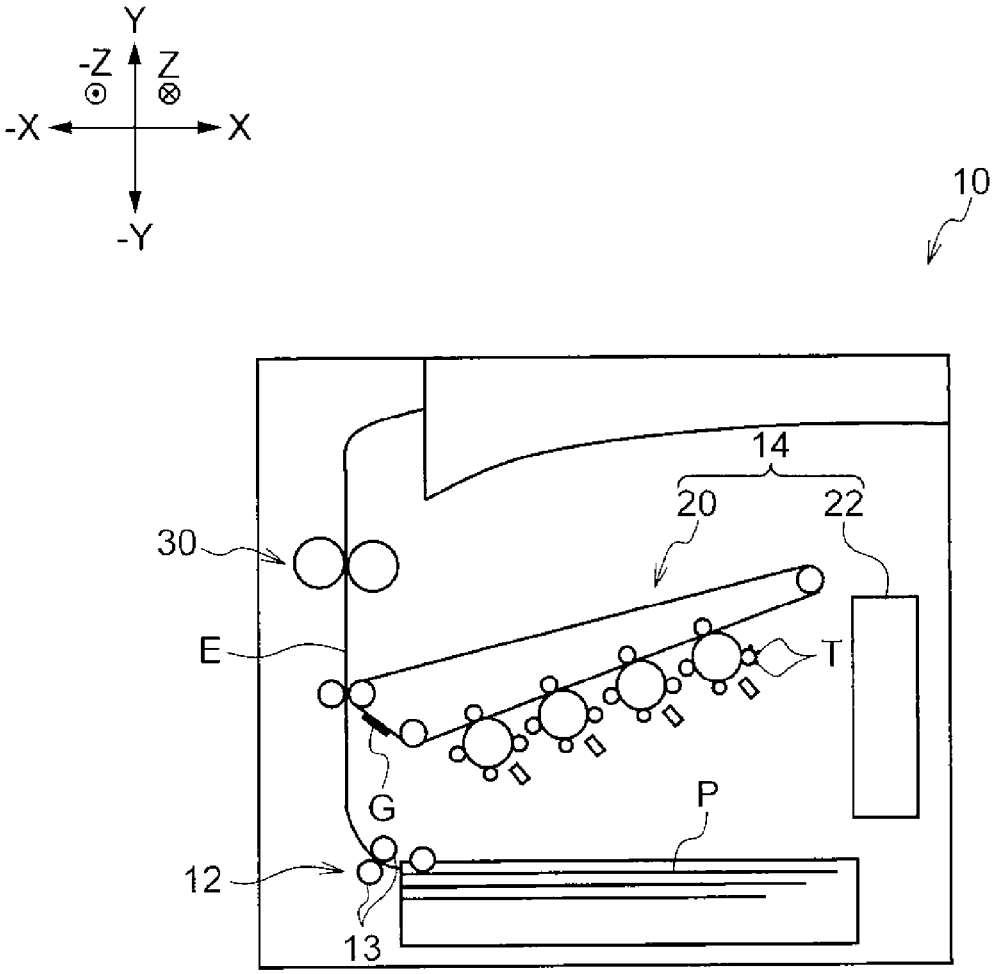
FIG. 1 is a configuration view illustrating an image forming apparatus according to a first exemplary embodiment.

In FIG. 1, an image forming apparatus 10 of the first exemplary embodiment is illustrated. For example, the image forming apparatus 10 includes: a transport unit 12 including a roll pair 13 that transports a paper P; an image forming portion 14 which forms a toner image G using toner T on the paper P transported by the transport unit 12; and a fixing device 30 which fixes the toner image G to the paper P by heating and pressurizing the toner image G. The paper P is an example of a recording medium. The toner T is an example of developer. The toner image G is an example of a developer image. The image forming portion 14 is an example of a developer image forming unit.

In addition, in the following description, the direction illustrated by an arrow Y in FIG. 1 is the apparatus height direction, and the direction illustrated by an arrow X is the apparatus width direction. In addition, the direction (illustrated by an arrow Z) which is orthogonal to each of the apparatus height direction and the apparatus width direction is the apparatus depth direction. In addition, while viewing the image forming apparatus 10 in a front view, the apparatus height direction, the apparatus width direction, and the apparatus depth direction are described as the Y direction, the X direction, and the Z direction. Furthermore, in a case where it is necessary to distinguish one side and the other side in the X direction, the Y direction, and the Z direction, while viewing the image forming apparatus 10 in a front view, an upper side is described as a Y side, a lower side is described as a −Y side, a right side is described as an X side, a left side is described as a −X side, a far side is described as a Z side, and a front side is described as a −Z side. A transport path E of the paper P goes, for example, along the Y direction.

The image forming portion 14 includes an image forming unit 20 and a controller 22 which controls operations of each portion of the image forming unit 20 and forms the toner image G on the paper P. The image forming unit 20 is configured, for example, to perform each processing, such as charging, exposing, developing, and transferring, which is a known electrophotographic process. In the image forming apparatus 10, the forming and the fixing of the toner image G on plural types of paper P having different lengths in the width direction, are performed.

[Configuration of Major Parts]

Next, the fixing device 30 will be described.

Figure 2:
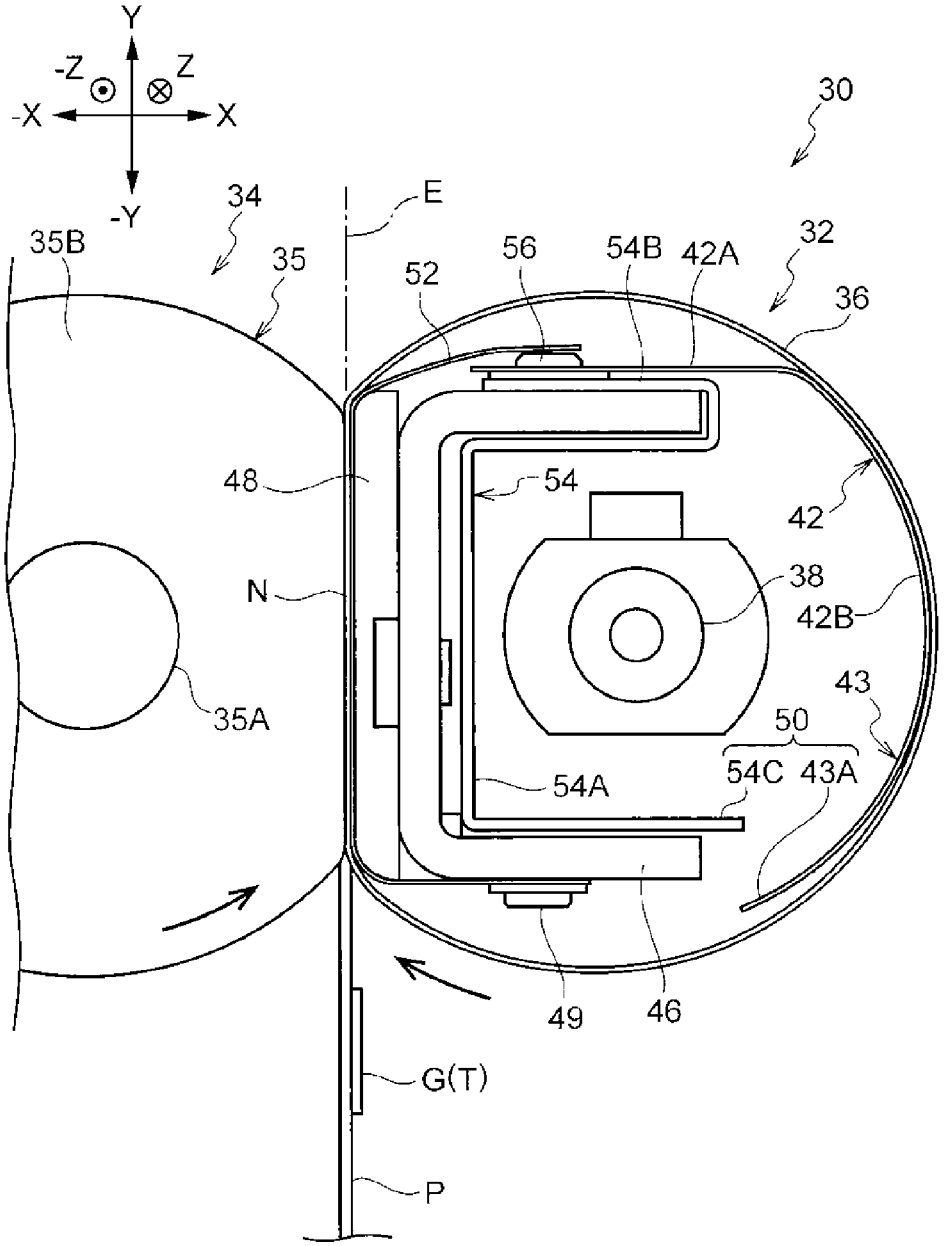
FIG. 2 is a view illustrating a configuration of a fixing device according to the first exemplary embodiment.

The fixing device 30 illustrated in FIG. 2 includes a heating unit 32 which is provided on the X side of the transport path E of the paper P and heats the toner image G, and a pressurizing unit 34 which is provided on the −X side of the transport path E and pressurizes the paper P and the toner image G toward the heating unit 32. In the exemplary embodiment, for example, the transport direction of the paper P in the fixing device 30 becomes the Y direction as described above, and the width direction of the paper P which is orthogonal to the Y direction becomes the Z direction.

<Pressurizing Unit>

The pressurizing unit 34 includes, for example, a pressurizing roll 35. The pressurizing roll 35 includes a columnar core bar 35A which considers the Z direction as the axial direction, and a sponge layer 35B which is formed on the outer circumferential surface of the core bar 35A. In addition, the pressurizing roll 35 is a long member which is longer than the width of the paper P in the Z direction. Both end portions in the axial direction of the core bar 35A are supported to be rotatable by a bearing attached to a bracket which is not illustrated. In addition, the core bar 35A is pressed toward a fixing belt 36 by a spring which is not illustrated so that the outer circumferential surface of the sponge layer 35B and the outer circumferential surface of the fixing belt 36 which will be described later are in contact with each other and a nip portion N which will be described later is formed. Furthermore, the core bar 35A rotates as the end portion on the Z side is driven by a motor which is not illustrated.

A part at which the outer circumferential surface of the fixing belt 36 and the outer circumferential surface of the pressurizing roll 35 nip the paper P, that is, a part at which the toner image G (toner T) on the paper P is heated and pressurized, is referred to as the nip portion N. In other words, the pressurizing roll 35 forms the nip portion N together with the fixing belt 36. In the exemplary embodiment, for example, when viewed in the Z direction, the nip portion N is formed in a straight line shape along the Y direction.

<Heating Unit>

The heating unit 32 includes the fixing belt 36, a halogen lamp 38, a heat transmitting member 42, a curved portion 43, a holder 46, a pad 48, a heat shielding unit 50, a sliding sheet 52, a reflection member 54, and a temperature sensor which is not illustrated. The fixing belt 36 is an example of a belt. The halogen lamp 38 is an example of a heat source. The curved portion 43 is an example of a deforming unit. The heat shielding unit 50 is an example of a heat shielding unit.

(Fixing Belt)

The fixing belt 36 is an endless belt (endless type), and for example, includes a base layer and a release layer with which the outer circumferential surface of the base layer is coated. Examples of a material which configures the base layer include a polymer, such as polyimide, polyamide, polyimideamide, or metal, such as stainless steel, nickel, or copper. In the exemplary embodiment, as an example, polyimide is used. The release layer is made of, for example, a tetrafluoroetylene-perfluoroalkylvinylether copolymer (PFA). In addition, the fixing belt 36 draws a track of movement which is close to a semicircle at parts except for the nip portion N by rigidity with respect to an external force which acts toward the inner side of the fixing belt 36.

Furthermore, the fixing belt 36 is disposed on the X side with respect to the transport path E of the paper P so as to be rotatable (circulate and move) around a shaft thereof which extends in the Z direction. The width in the Z direction of the fixing belt 36 becomes longer than the width in the Z direction of the paper P. Additionally, the fixing belt 36 is nipped by the pressurizing roll 35 and the sliding sheet 52 (pad 48), and is driven to be rotated by rotation of the pressurizing roll 35. In addition, the outer circumferential surface of the fixing belt 36 comes into contact with the toner image G on the paper P which has been transported through the transport path E. In addition, in both end portions of the fixing belt 36, a guide member which is not illustrated and prevents meandering of the fixing belt 36 in the Z direction, is provided.

(Holder)

The holder 46 is a long member which is manufactured through sheet metal processing and is longer than the width of the fixing belt 36 in the Z direction, and is a member in which an X-Y section is formed in a U shape. In addition, the holder 46 is disposed on the inner side of the fixing belt 36 in a state of being open to the X side. The holder 46 is supported by the bracket which is not illustrated.

(Pad)

The pad 48 is, for example, a long member which is made of polyethylene terephthalate (PET), and is longer than the width of the fixing belt 36 in the Z direction. In addition, the pad 48 is fixed on the inner side of the fixing belt 36, that is, on the −X side of a wall portion along the Y direction of the holder 46. Furthermore, the pad 48 is in contact with the X side surface of the sliding sheet 52. The both end portions of the pad 48 in the Y direction have an R shape which is convex toward the fixing belt 36.

(Sliding Sheet)

The sliding sheet 52 is fixed to the holder 46 by a screw 49 in a state where the sliding sheet 52 covers the −X side surface of the pad 48. In addition, the sliding sheet 52 is nipped by the fixing belt 36 and the pad 48 as the fixing belt 36 is pressurized by the pressurizing roll 35. Furthermore, the sliding sheet 52 is made of a material having a lower coefficient of friction between the fixing belt 36 and the sliding sheet 52 than a coefficient of friction between the fixing belt 36 and the pad 48.

(Reflection Member)

The reflection member 54 is a member made by bending a plate material which considers the Z direction as the longitudinal direction at plural locations in the lateral direction. Specifically, the reflection member 54 includes a reflection portion 54A which is disposed on the inner side of the holder 46, and an attaching portion 54B which is attached to the part on the Y side of the reflection portion 54A, that is, at a part on the Y side of the holder 46, by a screw 56. A section shape of an X-Y surface of reflection portion 54A is formed in a U shape which is open toward the X side.

In addition, the inner surface of the reflection portion 54A is a mirror surface. The reflection portion 54A reflects light of the halogen lamp 38 which will be described later toward an opposite side (X side) to the nip portion N side. In addition, a part of the reflection portion 54A on an opposite site to the attaching portion 54B side, that is, a part which protrudes further to the X side than the holder 46, is referred to as a protrusion portion 54C.

The temperature sensor which is not illustrated is provided on an entering side of the paper P of the nip portion N, that is, at a position opposing the outer circumferential surface of the fixing belt 36. In addition, the controller 22 (refer to FIG. 1) conducts electricity to the halogen lamp 38 in a case where the temperature of the fixing belt 36 sensed by the temperature sensor is lower than a predetermined fixing temperature, and stops the conduction to the halogen lamp 38 in a case where the temperature of the fixing belt 36 is higher than the fixing temperature. The fixing temperature is the temperature (for example, a lower limit temperature of the fixing) at which the toner image G can be fixed to the paper P. In addition, in the exemplary embodiment, a predetermined setting temperature is a temperature higher than the fixing temperature.

(Halogen Lamp)

The halogen lamp 38 is provided on the inner side of the fixing belt 36 and on the inner side of the reflection portion 54A so as to be in non-contact with the reflection portion 54A and elongate in the Z direction. The length in the Z direction of a light generating portion of the halogen lamp 38 becomes the length which is substantially the same as the width in the Z direction of the paper P having the largest size. In addition, the halogen lamp 38 is lighted by the conduction from the power source which is not illustrated, and emits radiant heat (light).

(Heat Transmitting Member)

Figure 3:
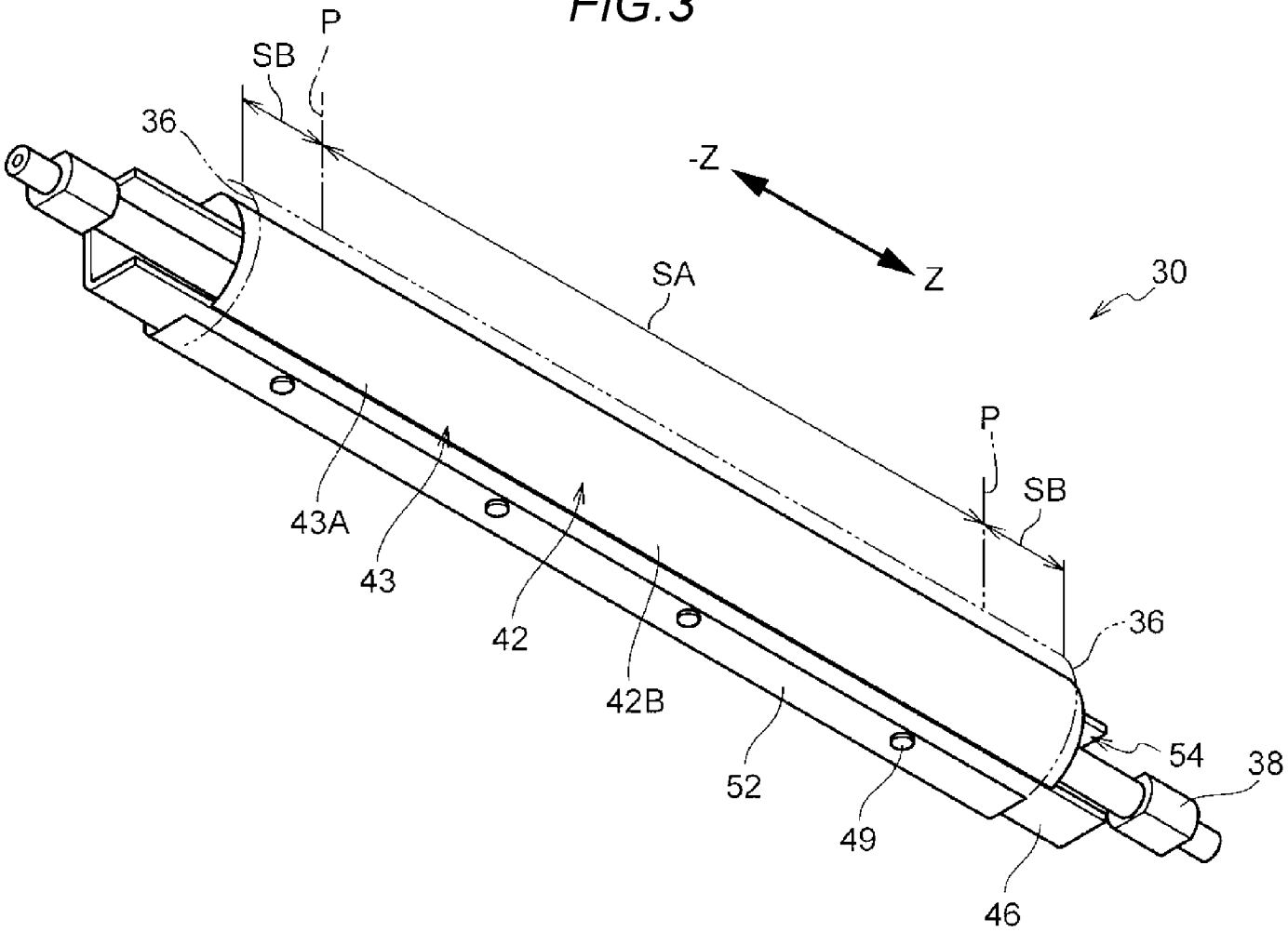
FIG. 3 is a perspective view illustrating a state where a fixing belt is removed in a heating unit according to the first exemplary embodiment.

As illustrated in FIG. 3, the heat transmitting member 42 is a member of which the length in the Z direction is longer than the length in the Z direction of the fixing belt 36, and is disposed on the inner side of the fixing belt 36. In addition, a region in which the paper P and the fixing belt 36 come into contact with each other in the Z direction is referred to as a contact region SA. In addition, a region which is located on the outer side of the contact region SA in the Z direction and in which the fixing belt 36 and the heat transmitting member 42 are in contact with each other and the paper P does not come into contact with the fixing belt 36, is referred to as a non-contact region SB. When the width in the Z direction of the paper P changes, a boundary between the contact region SA and the non-contact region SB also changes.

In addition, as illustrated in FIG. 2, the heat transmitting member 42 includes a fixing portion 42A having a straight line shape along the X direction when viewed in the Z direction, and a contact portion 42B which is at a part curved from the X-side end portion of the fixing portion 42A to be convex toward the X side and which is in contact with the inner circumferential surface of the fixing belt 36. Here, a part which configures at least a part of the contact portion 42B, that is, a part at which a curvature when the temperature exceeds the setting temperature is higher than a curvature when the temperature is equal to or lower than the above-described setting temperature (the curvature changes), is referred to as the curved portion 43 when viewed in the Z direction.

The fixing portion 42A is a part having a flat plate shape along an X-Z surface, and is fixed to an Y-side part of the holder 46 by the screw 56. The contact portion 42B is a part having a semicircular cylinder shape, and an end of the contact portion 42B on an opposite side to the fixing portion 42A side is a free end. In other words, the heat transmitting member 42 is supported by the holder 46 in a cantilever state. In a stop state where the fixing is not performed in the fixing device 30, the contact portion 42B is in contact with the inner circumferential surface (inner circumferential surface opposite to the nip portion N side in the X direction) on the X side of the rotation center position of the fixing belt 36.

In addition, the contact portion 42B is disposed between the halogen lamp 38 and the fixing belt 36. Furthermore, on the halogen lamp 38 side surface (inner surface) of the contact portion 42B is coated with a black color, which increases absorption of the radiant heat from the halogen lamp 38. Additionally, the contact portion 42B has such a size that the contact portion 42B covers an opening of the holder 46 and the halogen lamp 38 when the heating unit 32 is viewed from the X side to the −X side. In addition, in a state of being in contact with the fixing belt 36, the heat transmitting member 42 absorbs the radiant heat of the halogen lamp 38 and transmits the heat to the fixing belt 36.

The contact portion 42B (including the curved portion 43) of the heat transmitting member 42 is made of, for example, bimetal. The bimetal is a composite metal material made by bonding two metal plates having different thermal expansion coefficients. In addition, the heat transmitting member 42 having a high thermal expansion coefficient is located on the fixing belt 36 side, and the curvature changes according to a change in temperature.

Figure 4:
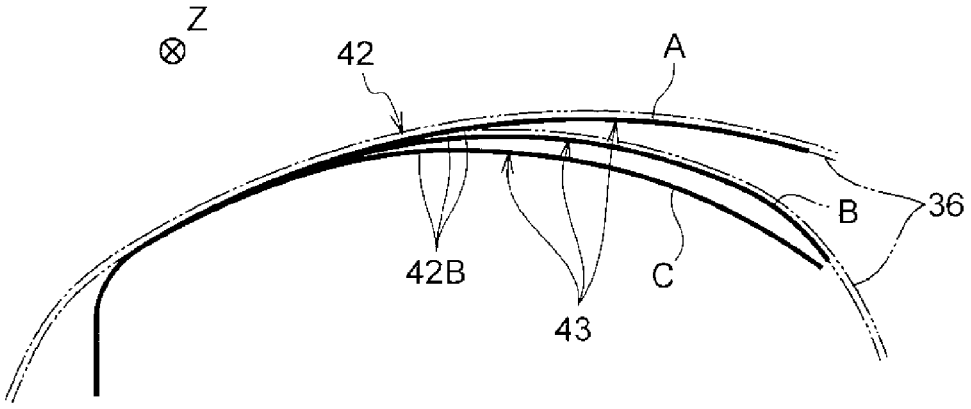
FIG. 4 is a view illustrating a shape when a heat transmitting member according to the first exemplary embodiment and a comparative example is viewed in the longitudinal direction.

As illustrated in FIG. 4, the contact portion 42B is placed in a curved state illustrated by a solid line A at the normal temperature (25 [° C.]), in a curved state illustrated by a solid line B at the fixing temperature, and in a curved state illustrated by a solid line C at the setting temperature which exceeds the fixing temperature. The solid line A, the solid line B, and the solid line C are in the curved state of being convex toward the fixing belt 36 side.

When the curvature of the solid line A is R1 [m⁻1], the curvature of solid line B is R2 [$m^{-1}$], and the curvature of the solid line C is R3 [$m^{-1}$], R1<R2<R3 is achieved. The curvatures R1, R2, and R3 are not illustrated in the drawing. Here, in a state of the curvature R1 and the curvature R2, the curved portion 43 comes into contact with the inner circumferential surface of the fixing belt 36. Meanwhile, in a state of the curvature R3, the curved portion 43 draws the track of the movement which is close to a semicircle except for the nip portion N (refer to FIG. 2) and is separated from the fixing belt 36.

In addition, a curve coefficient K which is an intrinsic coefficient of bimetal is described in JIS C 2530. In addition, according to a catalogue of bimetal of NEOMAX Materials, Co., Ltd., the curve coefficient K is obtained by $K=\{(1/r2-1/r1)\times t\}/\{2\times(T2-T1)\}$. A unit of the curve coefficient K is [$K^{-1}$]. r1 is a radius of curvature [m] before deforming bimetal, and r2 is a radius of curvature [m] after deforming bimetal. t is a thickness [m] of bimetal. T1 is a temperature [K] of bimetal before the deformation, and T2 is a temperature [K] of bimetal after the deformation. The design using the above-described equation of the curve coefficient K provides the heat transmitting member 42 which comes into contact with the inner circumferential surface of the fixing belt 36 at the fixing temperature and which is separated from the fixing belt 36 at the temperature which exceeds the setting temperature.

(Curved Portion)

In the curved portion 43 illustrated in FIG. 2, as described above, when viewed in the Z direction, the curvature R3 when the temperature exceeds the setting temperature becomes higher than the curvatures R1 and R2 when the temperature is equal to or lower than the setting temperature. In other words, the curved portion 43 deforms when the temperature exceeds the setting temperature, and becomes separated from the fixing belt 36.

In addition, the material of the heat transmitting member 42 is, for example, a material by which a heat resistant temperature of the heat transmitting member 42 becomes equal to or higher than 350 [° C.]. Specifically, Ni—Mo—Fe or Ni—Cr—Fe is used in a layer on a high expansion side (fixing belt 36 side), and Ni—Fe or Cr—Fe is used in a layer on a low expansion side (halogen lamp 38 side). Accordingly, compared to a case where a heat transmitting member made of a material having the heat resistant temperature lower than 350 [° C.], heat resistance of the heat transmitting member 42 increases.

(Heat Shielding Unit)

The heat shielding unit 50 includes, for example, a tip end portion 43A which is a −Y-side tip end of the curved portion 43, and the protrusion portion 54C of the reflection member 54. In other words, the curved portion 43 is included in the heat shielding unit 50. In addition, the heat shielding unit 50 is disposed on the inner side of the fixing belt 36 so that when the temperature of the curved portion 43 exceeds the setting temperature and the curved portion 43 is in a state of the curvature R3, the tip end portion 43A and the protrusion portion 54C are located between the halogen lamp 38 and the fixing belt 36. Accordingly, when the temperature of the curved portion 43 exceeds the setting temperature, the heat shielding unit 50 shields the radiant heat toward the fixing belt 36 from the halogen lamp 38.

[Actions]

Next, actions of the first exemplary embodiment will be described.

In the image forming apparatus 10 illustrated in FIG. 1, a raising operation of the fixing device 30 is started in accordance with the formation of the toner image G on the paper P by the image forming portion 14. Specifically, in the fixing device 30 illustrated in FIG. 2, the halogen lamp 38 is lighted, and the pressurizing roll 35 is started to rotate. By the rotation of the pressurizing roll 35, the fixing belt 36 starts the circulation and movement (being driven). At this time, on the side opposite to the nip portion N side, the contact portion 42B of the heat transmitting member 42 and the inner circumferential surface of the fixing belt 36 come into contact with each other.

Among light (radiant heat emitted from the halogen lamp 38) emitted from the halogen lamp 38, the light toward the X side of the halogen lamp 38 reaches the heat transmitting member 42 and is absorbed. Furthermore, the light toward the Y side, the −Y side, and the −X side of the halogen lamp 38 is reflected toward the X side by the reflection portion 54A, reaches the heat transmitting member 42, and is absorbed. In addition, in the heat transmitting member 42, the temperature increases by absorbing the light (radiant heat), and the heat is transmitted to the fixing belt 36. Accordingly, the temperature of the fixing belt 36 increases and reaches the fixing temperature. In the nip portion N, the toner image G on the paper P is fixed to the paper P as the toner image G is heated by the fixing belt 36 that has moved thereto and nipped and pressurized by the fixing belt 36 and the pressurizing roll 35.

In the fixing device 30, when the toner image G is fixed to the paper P having a small size, since the paper P is deprived of the heat in the contact region SA (refer to FIG. 3), the temperature of the fixing belt 36 and the heat transmitting member 42 of the contact region SA except for the nip portion N becomes lower than the fixing temperature. Here, by continuously supplying (heating) the radiant heat to the heat transmitting member 42 from the halogen lamp 38, the temperature of the contact region SA of the fixing belt 36 and the heat transmitting member 42 which enter the nip portion N increases to the fixing temperature.

Meanwhile, in the non-contact region SB (refer to FIG. 3), since the radiant heat is continuously supplied to the heat transmitting member 42 from the halogen lamp 38 while the paper P is not deprived of the heat, the temperature of the heat transmitting member 42 becomes higher than the fixing temperature. In addition, when the temperature of the heat transmitting member 42 becomes the setting temperature higher than the fixing temperature, the heat transmitting member 42 made of bimetal deforms so that the curvature of the curved portion 43 becomes higher than the curvature of the curved portion 43 at the time of the fixing temperature. Therefore, the fixing belt 36 and a part (curved portion 43) of the heat transmitting member 42 are separated from each other, and an amount of the heat transmitted to the non-contact region SB (refer to FIG. 3) of the fixing belt 36 from a part of the heat transmitting member 42 of which the temperature becomes equal to or higher than the setting temperature, decreases. Accordingly, the temperature of the non-contact region SB of the fixing belt 36 is prevented from excessively increasing. In addition, the temperature of the curved portion 43 which becomes equal to or higher than the fixing temperature decreases as the halogen lamp 38 is lighted as the fixing operation is finished.

In addition, in the fixing device 30, since the heat transmitting member 42 is made of bimetal, when the temperature of the heat transmitting member 42 becomes the setting temperature, the heat transmitting member 42 itself deforms so that the curvature increases. Therefore, compared to a configuration in which a unit that deforms the heat transmitting member 42 is set to be separated from the heat transmitting member 42 (curved portion 43), a configuration in which the heat transmitting member 42 is separated from the fixing belt 36 is a simple configuration.

Furthermore, in the fixing device 30, as the curvature of the heat transmitting member 42 increases when the temperature of the heat transmitting member 42 becomes the setting temperature, the tip end portion 43A of the curved portion 43 moves to the −X side (holder 46 side). Accordingly, compared to a case where the temperature of the heat transmitting member 42 is equal to or lower than the setting temperature, a part between the protrusion portion 54C of the reflection member 54 and the heat transmitting member 42 becomes narrow. In other words, the heat shielding unit 50 shields the radiant heat toward the fixing belt 36 from the halogen lamp 38. Accordingly, compared to a configuration in which the heat shielding unit 50 is not provided, the fixing belt 36 is prevented from being directly heated by the radiant heat (light) from the halogen lamp 38.

In the image forming apparatus 10 (refer to FIG. 1), the temperature of the non-contact region SB (refer to FIG. 3) in the fixing device 30 is prevented from excessively increasing. Therefore, even when the fixing is performed with respect to the paper P having a large size immediately after performing the fixing with respect to the paper P having a small size, the heat is prevented from being excessively supplied to the toner image G in both end portions in the Z direction of the paper P having a large size. Accordingly, compared to a configuration in which the fixing device 30 is not provided, an image defect (for example, hot offset) is prevented in the image forming apparatus 10 when the fixing is performed with respect to plural paper P having different lengths in the Z direction.

Second Exemplary Embodiment

Next, an example of the fixing device and the image forming apparatus according to a second exemplary embodiment will be described. In addition, members and parts which are basically the same as those of the above-described first exemplary embodiment will be given the same reference numerals as those of the above-described first exemplary embodiment, and the description thereof will be omitted.

Figure 5:
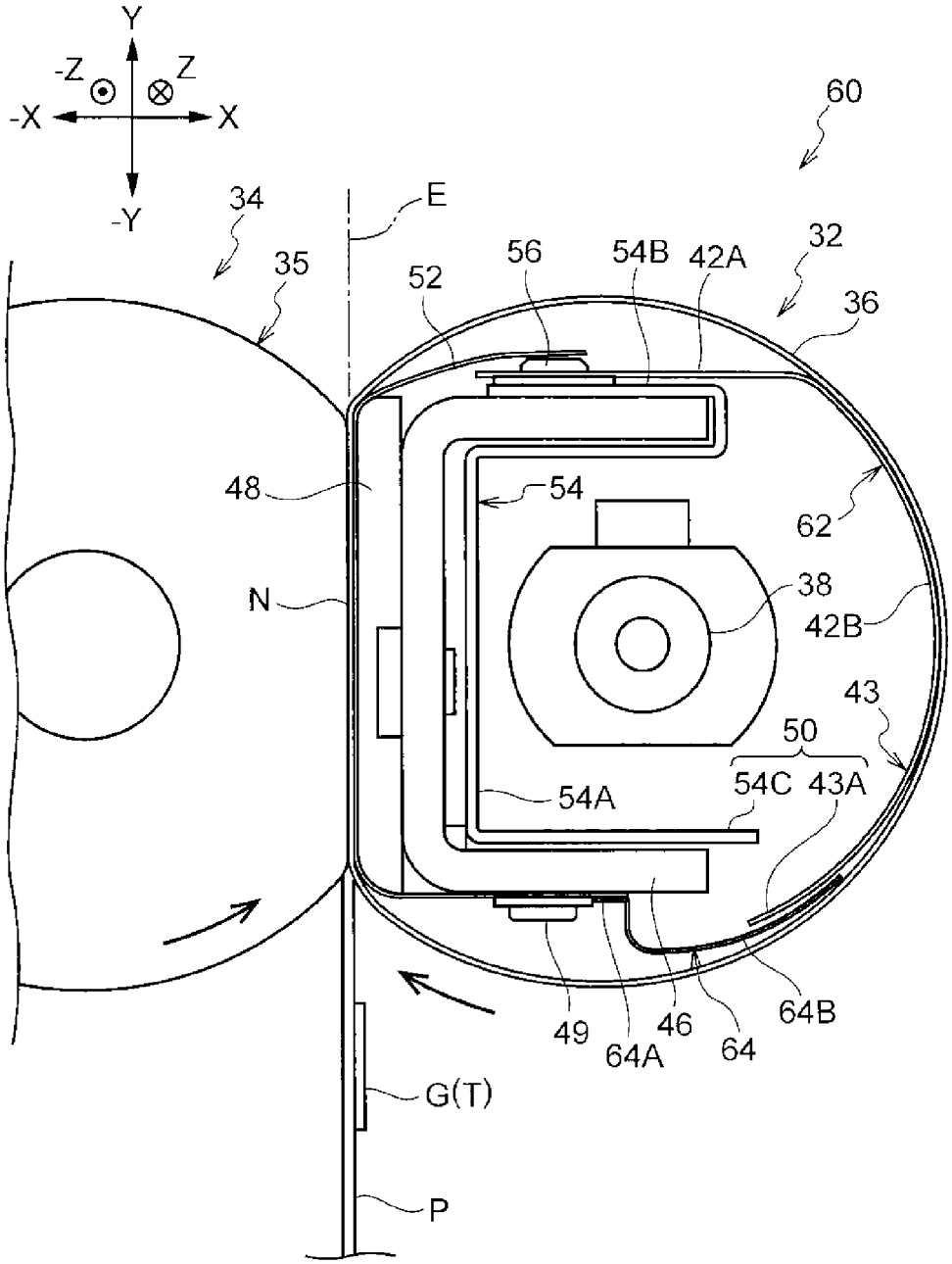
FIG. 5 is a view illustrating a configuration of a fixing device according to a second exemplary embodiment.

In FIG. 5, a fixing device 60 of the second exemplary embodiment is illustrated. The fixing device 60 has a configuration in which a heat transmitting member 62 is provided instead of the heat transmitting member 42 (refer to FIG. 2), and further, a claw member 64 which is an example of a restricting member is provided in the fixing device 30 (refer to FIG. 2) of the first exemplary embodiment.

Figure 7:
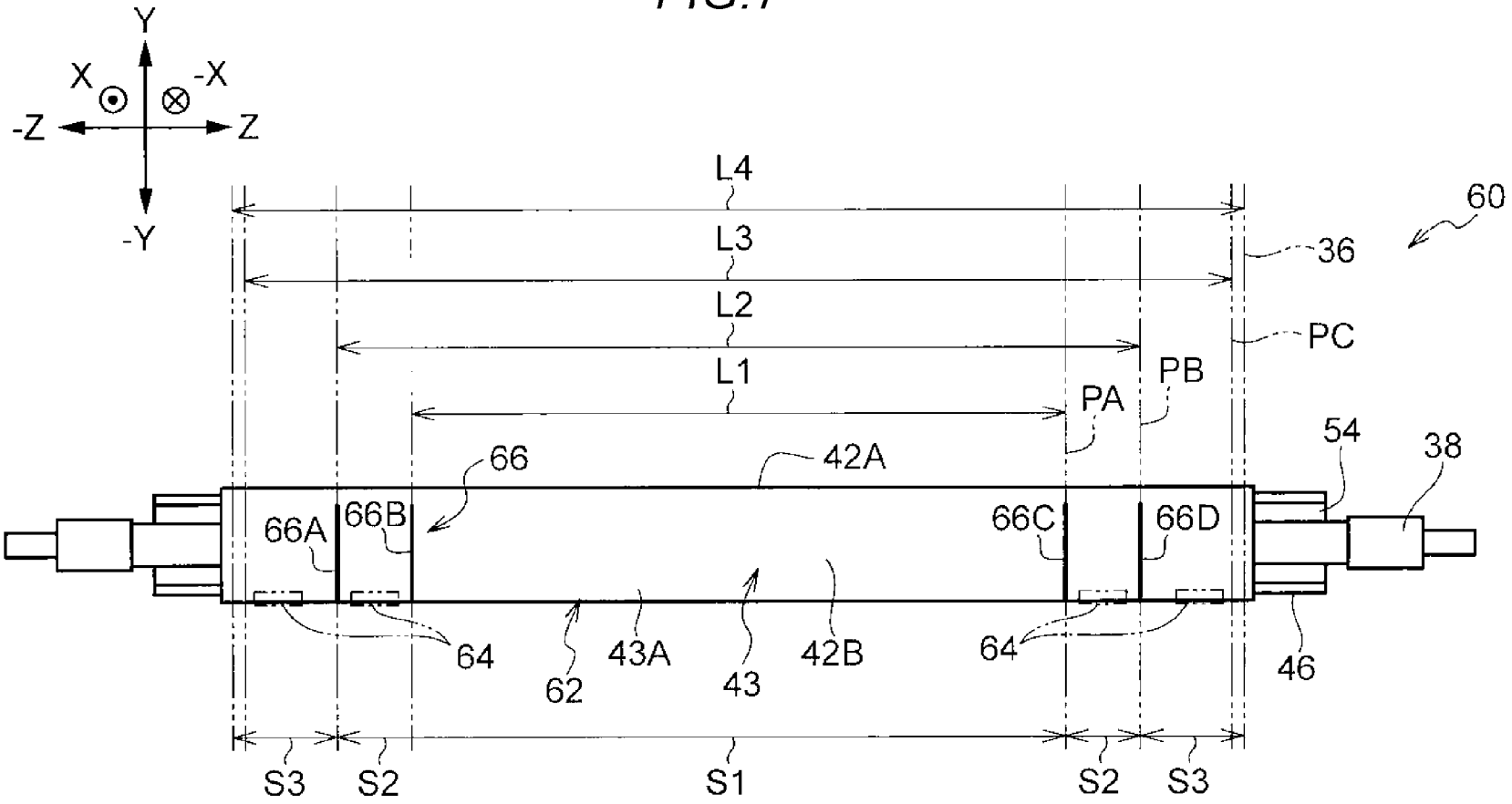
FIG. 7 is a view illustrating a disposition relationship between the heating unit according to the second exemplary embodiment and paper.

As illustrated in FIG. 7, among the paper P on which the image can be formed in the image forming apparatus 10 (refer to FIG. 1), the paper P of which the width in the Z direction is the shortest width L1 is a paper PA. In addition, the paper P of which the width in the Z direction is a width L2 (>L1) is a paper PB. Furthermore, the paper P of which the width in the Z direction is a width L3 (<L2) is a paper PC. The width in the Z direction of the fixing belt 36 is L4 (>L3). The paper PA, PB, and PC, for example, pass through the nip portion N (refer to FIG. 5) by a center resist which uses the center position of the fixing belt 36 as a reference.

In addition, the width in the Z direction of the heat transmitting member 62 becomes greater than L4.

(Heat Transmitting Member)

In the heat transmitting member 62, a cutout portion 66 which will be described later is formed. In addition, the heat transmitting member 62 is configured similar to the heat transmitting member 42 (refer to FIG. 2) of the first exemplary embodiment except for the cutout portion 66, and includes the fixing portion 42A and the contact portion 42B (including the curved portion 43).

The cutout portion 66 includes, for example, four cutouts 66A, 66B, 66C, and 66D which are formed in the contact portion 42B. The cutouts 66A, 66B, 66C, and 66D are formed in this order from the −Z side to the Z side when the heat transmitting member 62 is viewed from the X side to the −X side. In addition, the cutouts 66A, 66B, 66C, and 66D are respectively formed in a straight line shape along the Y direction in accordance with the width in the Z direction orthogonal to the transport direction (Y direction) of the paper PA, PB, and PC toward the fixing portion 42A from the tip end portion 43A (free end) of the contact portion 42B. In addition, the cutout is a notch which deeply enters a part of the heat transmitting member.

Specifically, the cutout 66A and the cutout 66D are formed at a position which corresponds to both end portions in the Z direction of the paper PB in the contact portion 42B. The cutout 66B and the cutout 66C are formed at a position which corresponds to both end portions in the Z direction of the paper PA in the contact portion 42B. Here, in the Z direction, a region from the cutout 66B to the cutout 66C is referred to as a first region S1, a region from the cutout 66A to the cutout 66B and a region from the cutout 66C to the cutout 66D are referred to as a second region S2. Furthermore, in the Z direction, a region located on the −Z side (outer side) of the cutout 66A and a region located on the Z side (outer side) of the cutout 66D are referred to as a third region S3.

The first region S1 is a contact region in which the paper PA and the fixing belt 36 are in contact with each other. The second region S2 becomes a non-contact region in which the paper PA and the fixing belt 36 does not come into contact with each other in a case where the paper PA is used, but becomes a contact region in a case where the paper PB is used. The third region S3 becomes a non-contact region in a case where the paper PB is used, but becomes a contact region in a case where the paper PC is used. In this manner, the contact portion 42B (curved portion 43) which deforms when reaching the above-described setting temperature is disposed on the outer side, in the Z direction, of the paper P to which the fixing is performed.

(Claw Member)

As illustrated in FIG. 5, the claw member 64 is formed by bending the plate material, and when viewed in the Z direction, the claw member 64 includes a fixing portion 64A which is along the X direction, and an extending portion 64B which is bent in a L shape and extends toward between the fixing belt 36 and the heat transmitting member 62. The fixing portion 64A is fixed to a surface on the −Y side of the holder 46 by a screw which is not illustrated or by adhesion. The tip end side (free end side) of the extending portion 64B is curved so as not to contact with the inner circumferential surface of the fixing belt 36.

Figure 6:
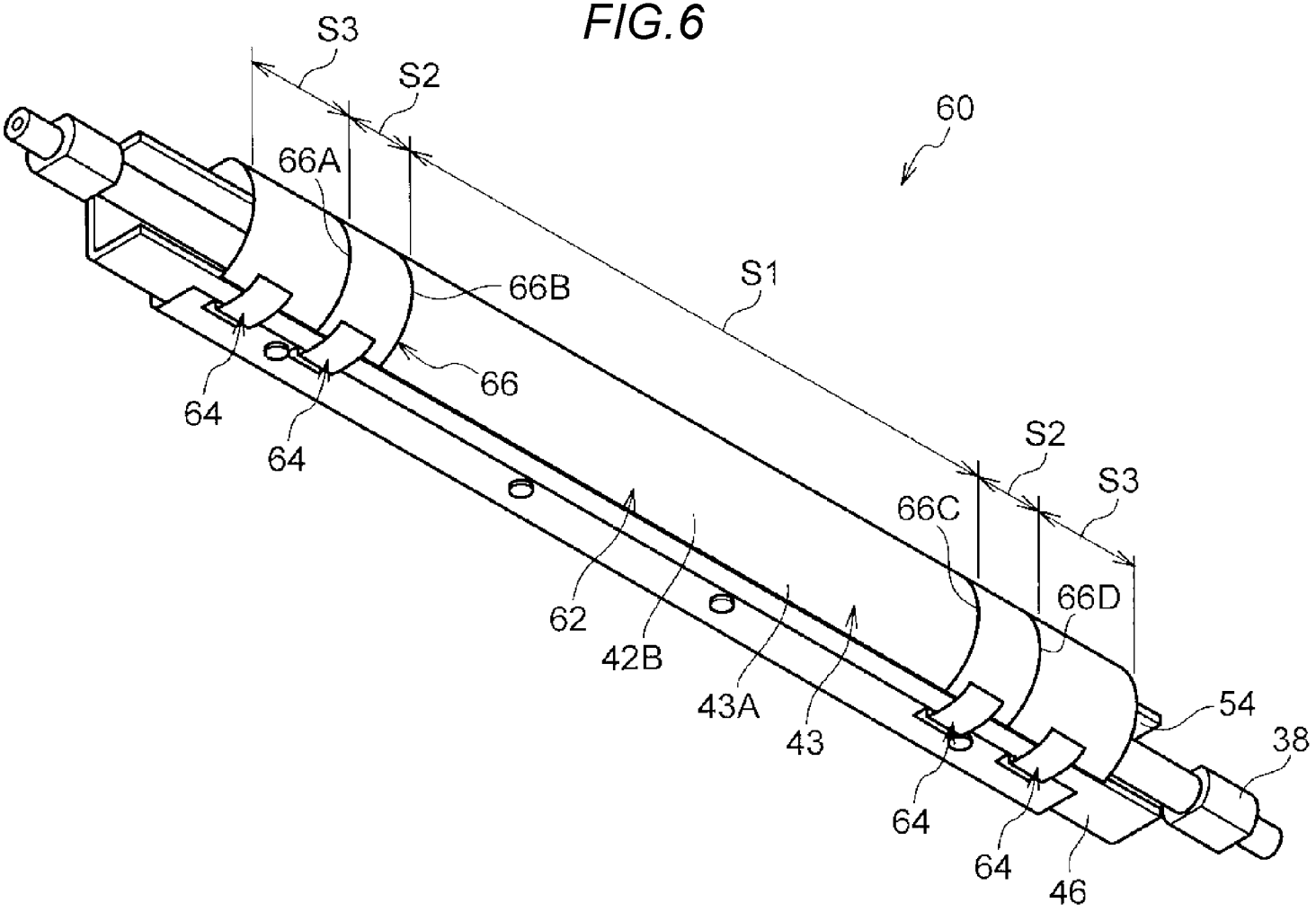
FIG. 6 is a perspective view illustrating a state where a fixing belt is removed in a heating unit according to the second exemplary embodiment.

As illustrated in FIGS. 6 and 7, the claw members 64 are respectively disposed one by one in two second regions S2 and in two third regions S3. In addition, as illustrated in FIG. 5, the extending portion 64B of the claw member 64 is disposed to restrict the movement of the contact portion 42B when the contact portion 42B of the heat transmitting member 62 deforms in the direction in which the curvature decreases and approaches the fixing belt 36. In other words, the claw member 64 restricts the curvature of the curved portion 43 to be lower than the curvature at the time of the setting temperature, when the temperature of the contact portion 42B is lower than the setting temperature.

[Actions]

Next, actions of the second exemplary embodiment will be described.

In the fixing device 60 illustrated in FIG. 7, when the toner image G (refer to FIG. 5) is fixed to the paper PA, since the paper PA is deprived of the heat in the first region S 1, the temperature of the fixing belt 36 and the heat transmitting member 62 of the first region S1 becomes lower than the fixing temperature. Here, by continuously supplying the radiant heat to the heat transmitting member 62 from the halogen lamp 38 (refer to FIG. 5), the temperature of the first region S1 of the fixing belt 36 and the heat transmitting member 62 increases to the fixing temperature.

Meanwhile, in the second region S2 and the third region S3, since the radiant heat is continually supplied to the heat transmitting member 62 while the paper PA is not deprived of the heat, the temperature of the heat transmitting member 62 becomes the setting temperature higher than the fixing temperature. When the temperature of the heat transmitting member 62 becomes the setting temperature, the heat transmitting member 62 deforms so that the curvature of the curved portion 43 becomes higher than the curvature at the time of the fixing temperature in the second region S2 and the third region S3. Therefore, the fixing belt 36 and the curved portion 43 in the second region S2 and the third region S3 are separated from each other, and the amount of the heat transmitted to the fixing belt 36 from the curved portion 43 of which the temperature becomes equal to or higher than the setting temperature, decreases. Accordingly, the temperature of the non-contact region (the second region S2 and the third region S3) of the fixing belt 36 is prevented from excessively increasing.

In addition, in the fixing device 60, the cutouts 66A, 66B, 66C, and 66D are formed in the contact portion 42B of the heat transmitting member 62. Therefore, in a case where the fixing is performed with respect to the paper PA, even when the curved portion 43 of the second region S2 and the third region S3 which are non-contact regions is deformed, the curved portion 43 in the contact region, that is, the first region S1 which does not require the deformation, is prevented from being deformed. In other words, the deformation of the curved portion 43 of the second region S2 and the third region S3 of the heat transmitting member 62 is unlikely to receive the influence in a state of the curved portion 43 of the first region S1. In this manner, in the fixing device 60, compared to a configuration in which the cutouts 66A, 66B, 66C, and 66D are not formed in the heat transmitting member 42 (refer to FIG. 2), the deformation of the curved portion 43 is prevented from influencing the presence or the absence of the deformation of a part that corresponds to the region being in contact with the paper P of the fixing belt 36 in the heat transmitting member 62.

Here, the fixing is performed with respect to the paper PB, the second region S2 of the heat transmitting member 62 becomes a contact region, the third region S3 becomes a non-contact region, and the temperature of the third region S3 exceeds the setting temperature. At this time, transmission of stress generated in accordance with the deformation of the curved portion 43 of the third region S3 of the heat transmitting member 62, to the curved portion 43 of the second region S2 is shielded in the cutouts 66A and 66D. In other words, even when the curved portion 43 of the third region S3 which is a non-contact region is deformed, the curved portion 43 in the contact region, that is, the second region S2 which does not require the deformation, is prevented from being deformed. In other words, the deformation of the curved portion 43 of the third region S3 is unlikely to receive the influence in a state of the curved portion 43 of the first region S1 and the second region S2.

Additionally, in the fixing device 60 illustrated in FIG. 5, when the temperature of the curved portion 43 becomes the temperature which is lower than the setting temperature, the curvature of the curved portion 43 becomes lower than the curvature of the curved portion 43 at the time of the setting temperature. At this time, the curved portion 43 deforms toward the fixing belt 36 (to a side close to the fixing belt 36). Here, when the curved portion 43 deforms toward the fixing belt 36, the tip end portion 43A of the curved portion 43 comes into contact with the claw member 64. Accordingly, compared to a configuration in which the claw member 64 is not provided, since the deformation of the curved portion 43 toward the fixing belt 36 is restricted, the curved portion 43 is prevented from being excessively pressed to the fixing belt 36, and a load which acts on the fixing belt 36 is prevented from increasing. In other words, the curved portion 43 is prevented from influencing the track of the movement of the fixing belt 36.

In addition, in the fixing device 60, when the temperature of the heat transmitting member 62 becomes the setting temperature, the curvature of the curved portion 43 increases, which moves the tip end portion 43A of the curved portion 43 to the −X side (holder 46 side). Accordingly, a part between the protrusion portion 54C of the reflection member 54 and the heat transmitting member 62 becomes narrow. In other words, the heat shielding unit 50 shields the radiant heat toward the fixing belt 36 from the halogen lamp 38. Accordingly, compared to a configuration in which the heat shielding unit 50 is not provided, the fixing belt 36 is prevented from being directly heated by the radiant heat (light) from the halogen lamp 38.

In the image forming apparatus 10 (refer to FIG. 1), the temperature of the second region S2 and the third region S3 in the fixing device 60 illustrated in FIG. 7 is prevented from excessively increasing. Therefore, even when the fixing is performed with respect to the paper PB or the paper PC having a large size immediately after performing the fixing with respect to the paper PA or the paper PB having a small size, the heat is prevented from being excessively supplied to the toner image G in both end portions in the Z direction of the paper PB or the paper PC having a large size. Accordingly, compared to a configuration in which the fixing device 60 is not provided, the image defect (for example, hot offset) is prevented in the image forming apparatus 10.

Third Exemplary Embodiment

Next, an example of the fixing device and the image forming apparatus according to a third exemplary embodiment will be described. In addition, members and parts which are basically the same as those of the above-described first and second exemplary embodiments will be given the same reference numerals as those of the above-described first and second exemplary embodiments, and the description thereof will be omitted.

Figure 8:
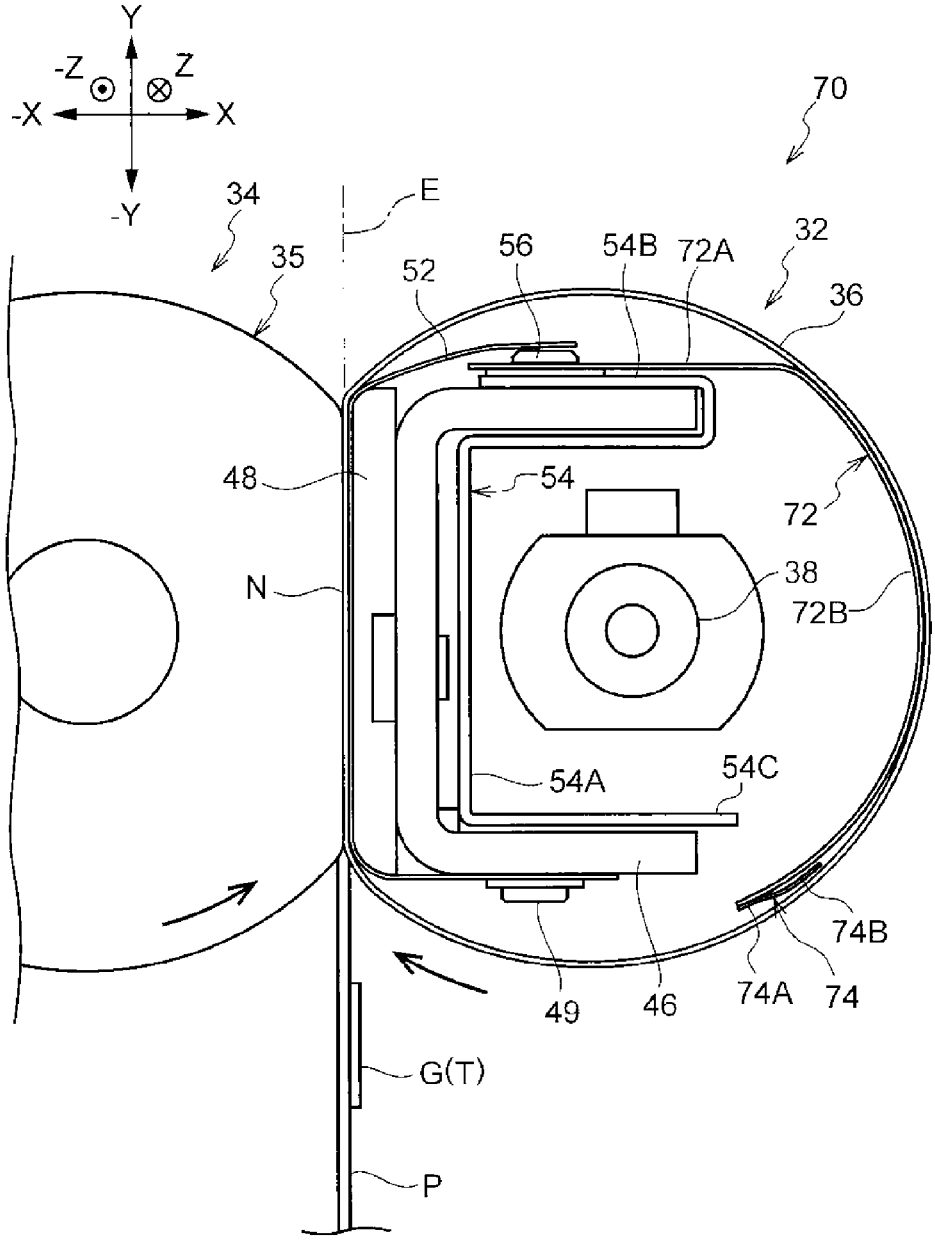
FIG. 8 is a view illustrating a configuration of a fixing device according to a third exemplary embodiment.

In FIG. 8, a fixing device 70 of the third exemplary embodiment is illustrated. The fixing device 70 has a configuration in which a heat transmitting member 72 is provided instead of the heat transmitting member 42 (refer to FIG. 2), and further, a deforming member 74 which is an example of a deforming unit is provided instead of the contact portion 42B (refer to FIG. 2) in the fixing device 30 (refer to FIG. 2) of the first exemplary embodiment.

(Heat Transmitting Member)

Figure 9:
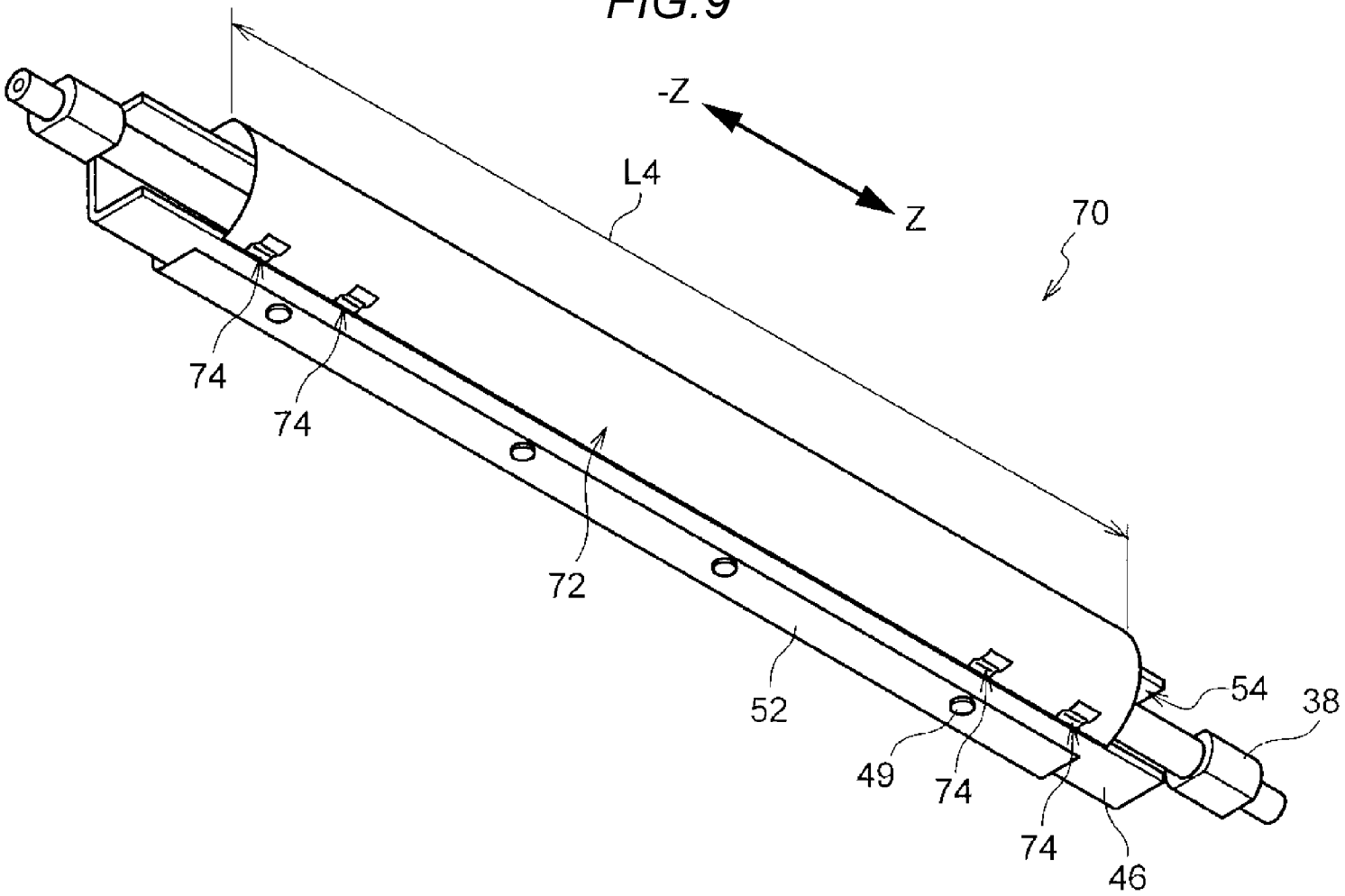
FIG. 9 is a perspective view illustrating a state where a fixing belt is removed in a heating unit according to the third exemplary embodiment.

As illustrated in FIG. 9, the heat transmitting member 72 is a member of which the length in the Z direction is the length L4 which is longer than the length in the Z direction of the fixing belt 36 (refer to FIG. 8), and is disposed on the inner side of the fixing belt 36. In addition, as illustrated in FIG. 8, the heat transmitting member 72 includes a fixing portion 72A having a straight line shape along the X direction when viewed in the Z direction, and a contact portion 72B which is at a part curved from the end portion on the X side of the fixing portion 72A to be convex toward the X side and which is in contact with the inner circumferential surface of the fixing belt 36. In addition, the heat transmitting member 72 is made of, for example, stainless steel (SUS). In other words, the heat transmitting member 72 is not made of bimetal.

The fixing portion 72A is fixed to a Y-side part of the holder 46 by the screw 56. The contact portion 72B is a part having a semicircular cylinder shape, and an end of the contact portion 62B on an opposite side to the fixing portion 72A side is a free end. In addition, the contact portion 72B is disposed to be in contact with the inner circumferential surface of the fixing belt 36. Furthermore, the contact portion 72B is disposed between the halogen lamp 38 and the fixing belt 36.

Additionally, on the surface (inner surface) on the halogen lamp 38 side of the contact portion 72B, coating in black color is performed, and absorption of the radiant heat from the halogen lamp 38 increases. In addition, the size of the contact portion 72B becomes the size which covers the opening of the holder 46 and the halogen lamp 38 when the fixing device 70 is viewed from the X side to the −X side. In addition, in a state of being in contact with the fixing belt 36, the heat transmitting member 72 absorbs the radiant heat of the halogen lamp 38 and transmits the heat to the fixing belt 36.

(Deforming Member)

As illustrated in FIG. 8, the deforming member 74 is formed by bending the plate material, and includes a fixing portion 74A fixed to the contact portion 72B and an extending portion 74B which extends toward between the fixing belt 36 and the heat transmitting member 72 from the fixing portion 74A, when viewed in the Z direction. The fixing portion 74A is welded to the tip end portion (the free end portion, that is, the end portion on the −Y side) of the contact portion 72B. The tip end side (free end side) of the extending portion 74B is curved not to be in contact with the inner circumferential surface of the fixing belt 36 when the temperature of the heat transmitting member 72 is equal to or lower than the setting temperature. As illustrated in FIG. 9, plural (four) deforming members 74 are provided, for example, to be aligned in the Z direction in the contact portion 72B.

The deforming member 74 is made of, for example, bimetal of which the temperature becomes equal to or higher than 350 [° C.]. Specifically, Ni—Mo—Fe or Ni—Cr—Fe is used in a layer on a high expansion side (heat transmitting member 72 side), and Ni—Fe or Cr—Fe is used in a layer on a low expansion side (fixing belt 36 side). In addition, the extending portion 74B separates the fixing belt 36 from the contact portion 72B as the extending portion 74B deforms when the temperature (temperature of the deforming member 74) of the contact portion 72B exceeds the above-described setting temperature, comes into contact with the fixing belt 36, and presses the fixing belt 36 to the outer side in the radial direction.

[Actions]

Next, actions of the third exemplary embodiment will be described.

Figure 10A:
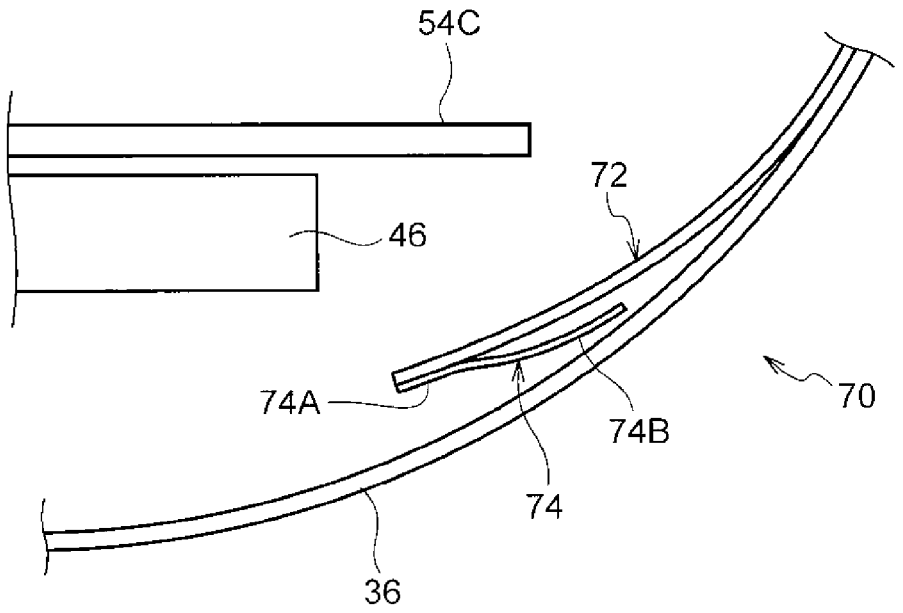
FIG. 10A is a view illustrating a part of the heating unit according to the third exemplary embodiment.

In the fixing device 70 illustrated in FIG. 8, when the toner image G is fixed to the paper P, since the paper P is deprived of the heat, the temperature of the contact region which is in contact with the paper P of the fixing belt 36 and the temperature of the heat transmitting member 72 of the contact region decrease to be lower than the fixing temperature. Here, as the radiant heat is continuously supplied (heated) to the heat transmitting member 72 from the halogen lamp 38, the temperature of the contact region of the fixing belt 36 and the temperature of the contact region of the heat transmitting member 72 increase to the fixing temperature. At this time, as illustrated in FIG. 10A, the deforming member 74 and the fixing belt 36 are separated from each other.

Meanwhile, in the non-contact region of the fixing belt 36 in which the fixing belt 36 does not come into contact with the paper P and the heat transmitting member 72 in the non-contact region, the paper P is not deprived of the heat, and the radiant heat is continuously supplied to the heat transmitting member 72. Therefore, the temperature of the heat transmitting member 72 in the non-contact region becomes higher than the fixing temperature.

Figure 10B:
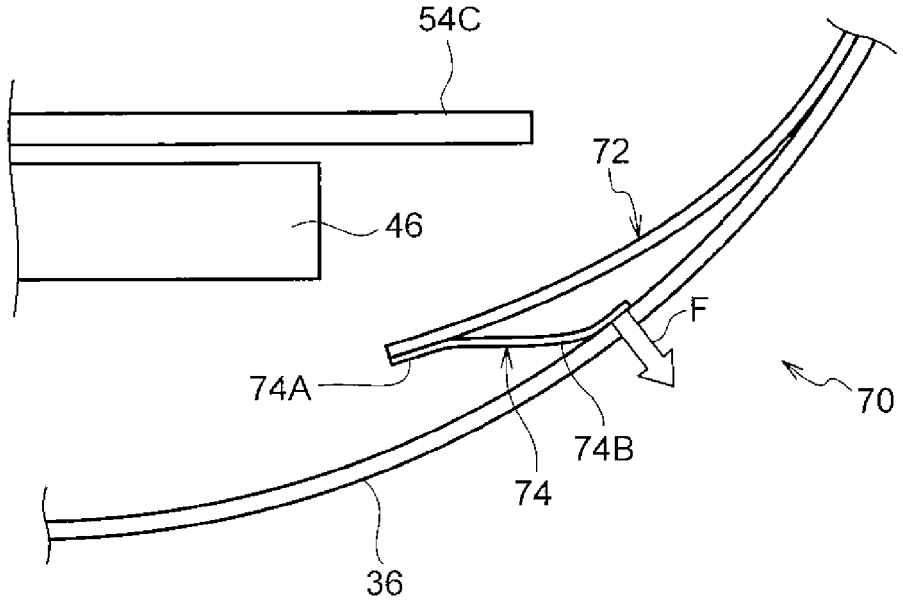
FIG. 10B is a view illustrating a state where a claw portion presses the fixing belt in the heating unit according to the third exemplary embodiment.

Here, as illustrated in FIG. 10B, the temperature of the heat transmitting member 72 becomes the setting temperature higher than the fixing temperature. At this time, the extending portion 74B of the deforming member 74 deforms to the fixing belt 36 side, and as illustrated with an arrow F, since the fixing belt 36 extends to the outer side in the radial direction, the fixing belt 36 is separated from the heat transmitting member 72. Accordingly, since the amount of the heat transmitted to the fixing belt 36 from a part of the heat transmitting member 72 of which the temperature becomes the setting temperature, decreases, the temperature of the non-contact region of the fixing belt 36 is prevented from excessively increasing.

In addition, in the fixing device 70, by using the deforming member 74, even when the heat transmitting member 72 itself is not deformed, the heat transmitting member 72 and the fixing belt are separated from each other. Therefore, it is possible to effectively use the above-described configuration of the fixing device.

In the image forming apparatus 10 (refer to FIG. 1), the temperature of the non-contact region in the fixing device 70 is prevented from excessively increasing. Therefore, even when the fixing is performed with respect to the paper P having a large size immediately after performing the fixing with respect to the paper P having a small size, the heat is prevented from being excessively supplied to the toner image G in both end portions in the Z direction of the paper P having a large size. Accordingly, compared to a configuration in which the fixing device 70 is not provided, the image defect (for example, hot offset) is prevented in the image forming apparatus 10.

In addition, the invention is not limited to the above-described exemplary embodiments.

In the fixing device 30, the curved portion 43 may configure not only a part of the contact portion 42B, but also the entire contact portion 42B. In addition, in the fixing device 30, a part of the reflection member 54 may extend, and the claw member 64 may also be provided.

In the fixing device 60, when the temperature of the heat transmitting member 62 becomes lower than the setting temperature, in a case where the contact between the heat transmitting member 62 and the fixing belt 36 does not cause a problem, (for example, a case where the contact does not influence the circulation and movement of the fixing belt 36), the claw member 64 may not be provided. Furthermore, in the fixing device 60, in a case where the protrusion portion 54C of the reflection member 54 extends and the radiant heat toward the fixing belt 36 is shielded, when the temperature of the contact portion 42B becomes the setting temperature, the tip end portion 43A may not be located between the halogen lamp 38 and the fixing belt 36.

The heat transmitting members 42 and 62 are not limited to members made of bimetal. Alternatively, the heat transmitting members 42 and 62 may be one obtained by combining resins having different thermal expansion coefficients. In addition, the heat transmitting members 42 and 62 may be made of a shape memory alloy. Furthermore, the heat transmitting members 42 and 62 may be made of trimetal. The trimetal is composite metal material made by bonding three metal plates having different thermal expansion coefficients. In a case where the heat transmitting members 42 and 62 are made of trimetal, when using a copper alloy material which has high thermal conductivity in an intermediate layer among the three layers, the heat is likely to be equivalently transmitted in the circumferential direction of the fixing belt 36. Additionally, not being limited to the members in which a part that corresponds to the contact region and a part that corresponds to the non-contact region are linked to each other in the Z direction, the heat transmitting members 42 and 62 may be divided (separated) members.

The contact portion between the fixing belt 36 and the heat transmitting members 42, 62, and 72 may be coated with oil or grease.

The fixing device 70 may be configured so that the deforming member 74 is held by a holder and the holder contacts with the heat transmitting member 72.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an endless belt that comes into contact with a developer image on a recording medium;

a heat source that is provided on an inner side of the belt and emits radiant heat;

a heat transmitting member that includes a contact portion which contacts with an inner circumferential surface of the belt, absorbs the radiant heat of the heat source, and transmits the heat to the belt; and a deforming unit that deforms when a temperature of the contact portion exceeds a predetermined setting temperature, and separates the belt and at least a part of the contact portion from each other, wherein the deforming unit is a curved portion that configures at least a part of the contact portion and that has a higher curvature when the temperature exceeds the setting temperature than that when the temperature is equal to or lower than the setting temperature, when viewed in an axial direction of the belt, wherein a cutout is formed in the heat transmitting member along a transport direction of a recording medium in accordance with a size of the recording medium in a width direction orthogonal to the transport direction, and wherein the curved portion is disposed at least on an outer side of the cutout in the width direction.

* * * * *